US010286287B2

(12) United States Patent
King

(10) Patent No.: US 10,286,287 B2
(45) Date of Patent: May 14, 2019

(54) FACE SHIELD

(71) Applicant: Darrel W. King, Alhambra, CA (US)

(72) Inventor: Darrel W. King, Alhambra, CA (US)

( * ) Notice: Subject to any disclaimer, the term of this patent is extended or adjusted under 35 U.S.C. 154(b) by 55 days.

(21) Appl. No.: 15/397,099

(22) Filed: Jan. 3, 2017

(65) Prior Publication Data

US 2018/0185733 A1 Jul. 5, 2018

(51) Int. Cl.

| | |
|---|---|
| ***A42B 3/20*** | (2006.01) |
| ***A63B 71/10*** | (2006.01) |
| ***A41D 13/11*** | (2006.01) |
| *A63B 102/18* | (2015.01) |

(52) U.S. Cl.

CPC ..... *A63B 71/10* (2013.01); *A41D 13/1161* (2013.01); *A42B 3/20* (2013.01); *A63B 2102/18* (2015.10); *A63B 2209/10* (2013.01); *A63B 2243/0025* (2013.01); *A63B 2243/0037* (2013.01); *A63B 2243/0066* (2013.01); *A63B 2243/0095* (2013.01); *A63B 2244/10* (2013.01)

(58) Field of Classification Search

CPC ..... A42B 3/20; A42B 3/222; A61F 9/04
See application file for complete search history.

(56) References Cited

U.S. PATENT DOCUMENTS

| | | | | |
|---|---|---|---|---|
| 3,878,563 A * | 4/1975 | Pulju | A41D 13/1161 | 2/9 |
| 5,206,955 A * | 5/1993 | Milligan | A42B 3/20 | 2/424 |
| 5,537,687 A * | 7/1996 | Garza | A63B 71/10 | 2/206 |
| 5,765,231 A * | 6/1998 | Leonard | A41G 7/00 | 128/857 |
| 5,940,886 A * | 8/1999 | McCarthy Smith | A61F 11/12 | 2/15 |
| 6,012,164 A * | 1/2000 | Deal, III | A63B 71/10 | 2/9 |
| 7,000,252 B1 * | 2/2006 | Tobin | A63B 71/10 | 2/9 |

* cited by examiner

*Primary Examiner* — Tajash D Patel
(74) *Attorney, Agent, or Firm* — Charles C. H. Wu; Charles C.H. Wu & Assoc., APC

(57) ABSTRACT

The invention provides a face shield for sports activities. The face shield comprises a facial covering shield, a plurality of foam pads, a nose shield portion and a pair of detachable straps. The facial covering shield has a pair of eye openings. The pair of detachable straps around the cheek and the forehead are fully adjustable and provide a comfortable and secure fit for the user. The nose shield portion protects the user's nose from injuries. The plurality of foam pads includes a pair of forehead pads and a pair of cheek pads, and, the plurality of foam pads are removable and reusable and can be adjusted to desired position to create perfect fit for the user's face. The design of the face shield is more unique and fits on the top of the forehead and leaves plenty of space and protects the eye portion and reduces and eliminates vision problems.

10 Claims, 5 Drawing Sheets

FACE SHIELD

CROSS-REFERENCE TO RELATED APPLICATIONS

Not Applicable.

BACKGROUND OF THE DISCLOSURE

Field of the Disclosure

The present embodiment relates generally to face masks; more particularly to a face shield for sport's participants to protect injured forehead, cheeks and nose portions while engaging in sports activities.

Discussion of Related Art

Much of today's society is very involved in sports and recreational activities. But injuries are often a part of such activities and can prevent athletes from participating, particularly with injuries to the face. Further, participating in sports with an injured face may lead to infections or further complications. The only way to avoid such complications while participating in sports with a face injury is to wear a face mask. Conventional methods utilize clothes specifically folded and tied around the head covering the face, to protect these injuries from further damage. But existing methods can be uncomfortable, and may not completely cover the facial injury and can easily fall off during the activity.

Face masks with different features have evolved as a solution for facial injury protection during sports. One such method involves a flexible face mask for protecting the face from sunlight, wind, and other outdoor elements. Various embodiments of the face mask provide varying levels of facial coverage to suit user preferences. One embodiment protects most of the face but fails to protect the forehead region. Another embodiment introduces a ventilated mask for outdoor use to protect the wearer against insects and flying debris. The mask covers the user's nose, mouth and cheek area, and has a removable visor to provide protection for the eyes as well. The mask uses a snap in filter for additional protection against dust or other airborne irritants. The filter is held in place on the user's head by a pair of adjustable elastic straps.

These methods fail to provide a comfortable mask which protects the entire face. In addition, these methods do not provide a cost effective method to keep the mask from slipping during the vigorous movements which occur while engaged in athletic activity.

Therefore, there is a need for a simple, cost effective face shield or guard that covers the entire face of a sport's participant engaged in athletic activity. Such a needed mask would contain an efficient method to hold the mask in place such that it does not slip off during vigorous movement. Such a needed device would provide protection especially to the cheeks, forehead and nose portions of the face. Such a needed device would provide a padded portion to add more user comfort while in use. The present embodiment overcomes prior art shortcomings in this area by accomplishing these critical objectives.

SUMMARY OF THE DISCLOSURE

To minimize the limitations found in the prior art, and to minimize other limitations that will be apparent upon the reading of the specification, the present invention is a face shield to protect the user from injury to the face.

The face shield comprises a facial covering shield, a plurality of foam pads, a nose shield portion and a pair of detachable straps. The facial covering shield includes a pair of eye openings. The nose shield portion protects the user's nose from injuries. The pair of detachable straps around the cheek and the forehead are fully adjustable and provide a comfortable and secure fit for the user.

The plurality of foam pads includes a pair of forehead pads and a pair of cheek pads to protect the user's forehead and cheek and to protect the user from injuries. The plurality of foam pads is removable and reusable and is adjustable to desired position to create perfect fit for the user's face. The removable and reusable adhesive in the plurality of foam pad is used to fix the plurality of foam pads to the face shield. The face shield allows the user to remain active by protecting and supporting injured forehead, cheek bones and noses. The design of the face shield is more unique, fits on the top of the forehead, leaves plenty of space and protects the eye portion and reduces and eliminates vision problems.

A first objective of the present invention is to provide a face shield that allows the user to remain active by protecting and supporting injured forehead, cheek bones and noses.

A second objective of the present invention is to provide a face shield having a unique design, fits on the top of the forehead, leaves plenty of space and protects the eye portion, and reduces and eliminates vision problems.

A third objective of the present invention is to provide a face shield having a plurality of foam pads that is removable and reusable and adjustable to a desired position to create the perfect fit for the user's face.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE PREFERRED EMBODIMENT

In the following discussion that addresses a number of embodiments and applications of the present invention, reference is made to the accompanying drawings that form a part hereof, and in which is shown by way of illustrating specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below. The invention will now be described with reference to the accompanying drawing which does not limit the scope and the ambit of the invention.

Figure 1:
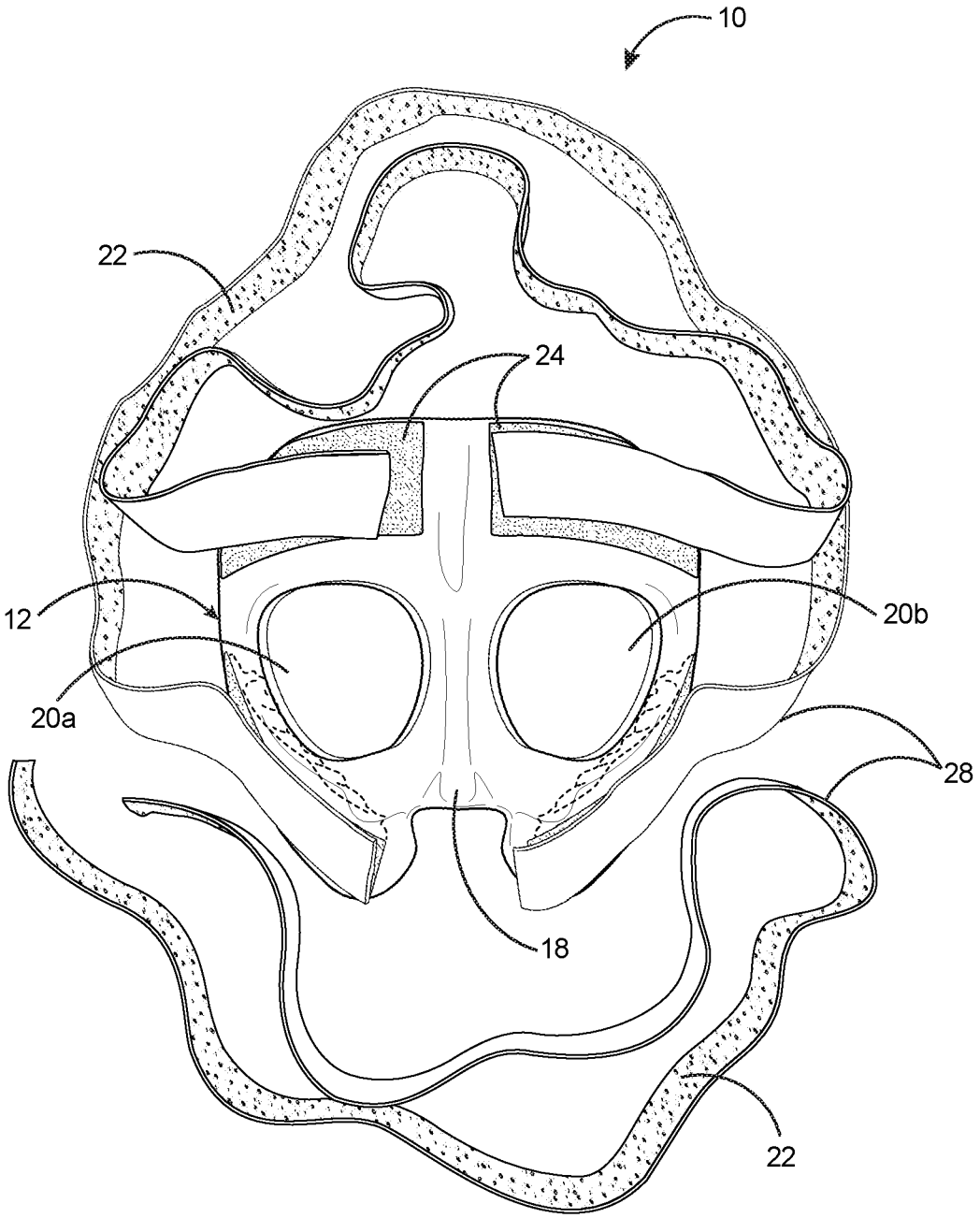
FIG. 1 is a front view of the face shield in accordance with a preferred embodiment of the present invention.

Turning first to FIG. 1, a top perspective view of an outer portion of the face shield 10 in accordance with a preferred embodiment of the present invention is illustrated. The face shield 10 comprises a face covering shield 12 having a pair of eye openings (20*a* and 20*b*). The pair of eye openings (20*a* and 20*b*) includes a left eye opening 20*b* at a left edge of the facial covering shield and a right eye opening 20*a* at a right edge of the facial shield. The face shield 10 comprises a nose shield portion 18 to cover and protect nose of a user 26. The face shield also contains a pair of detachable straps 28. The pair of detachable straps 28 includes at least one loop portion 22 of a Velcro fastener to fasten the detachable straps 28 with the facial covering shield 12. A plurality of Velcro hook portions 24 is attached with the at least one loop portion 22 at the ends of each of the pair of detachable straps 28.

Figure 2:
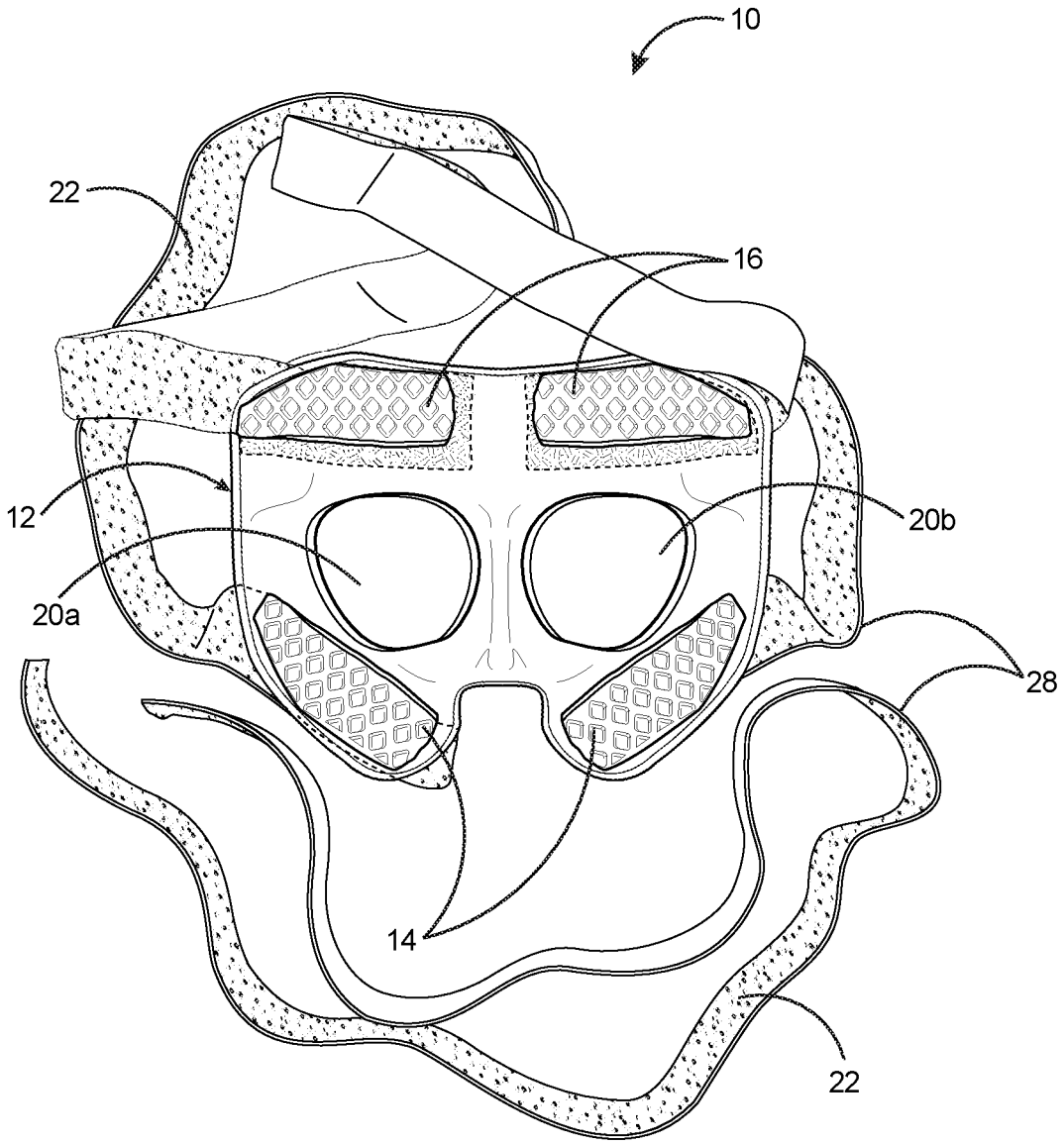
FIG. 2 is a rear view of the face shield in accordance with the preferred embodiment of the present invention.

FIG. 2 illustrates a top perspective view of the inner portion of the face shield 10 in accordance with the preferred embodiment of the present invention. The face shield 10 contains a plurality of foam pads (14 and 16, hereinafter referred to as cheek pads 14 and forehead pads 16), to protect the forehead and cheek of the user 26. The pair of forehead pads 16 and the pair of cheek pads 14 protects the user 26 from injuries. The pair of forehead pads 16 and the pair of cheek pads 14 are removable and reusable and can be adjusted to desired position to create perfect fit for the face of the user 26. The pair of forehead pads 16 and the pair of cheek pads 14 are made up of Ethylene-vinyl acetate (EVA) foam. The pair of forehead pads 16 and the pair of cheek pads 14 include removable and reusable adhesive that enables the pair of forehead pads 16 and the pair of cheek pads 14 to fix on to the face of the user 26. The pair of detachable straps around the cheek and the forehead are fully adjustable and provide a comfortable and secure fit for the user 26. The removable and reusable adhesive in the pair of forehead pads 16 and the pair of cheek pads 14 are used to fix the pair of forehead pads 16 and the pair of cheek pads 14 to the face shield 10.

Figure 3A:
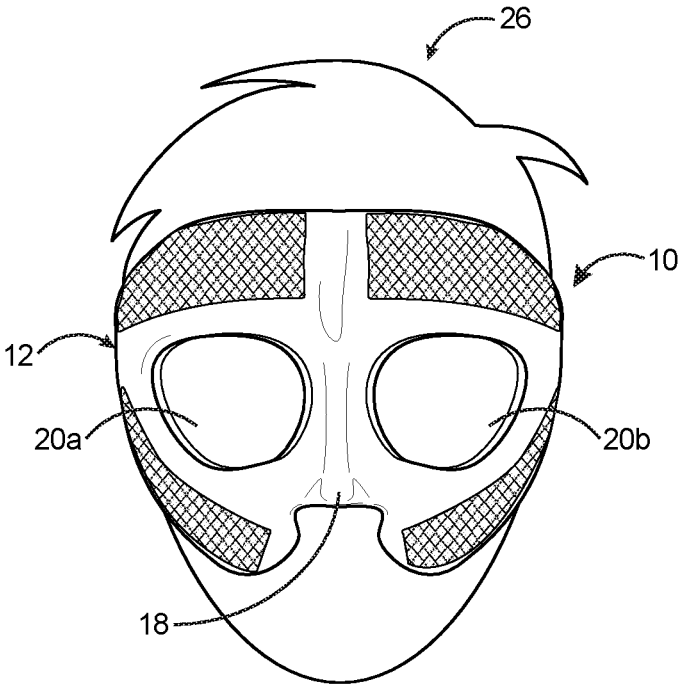
FIGS. 3A and 3B are the front and side views of the face shield attached to the face of a user respectively.
Figure 3B:
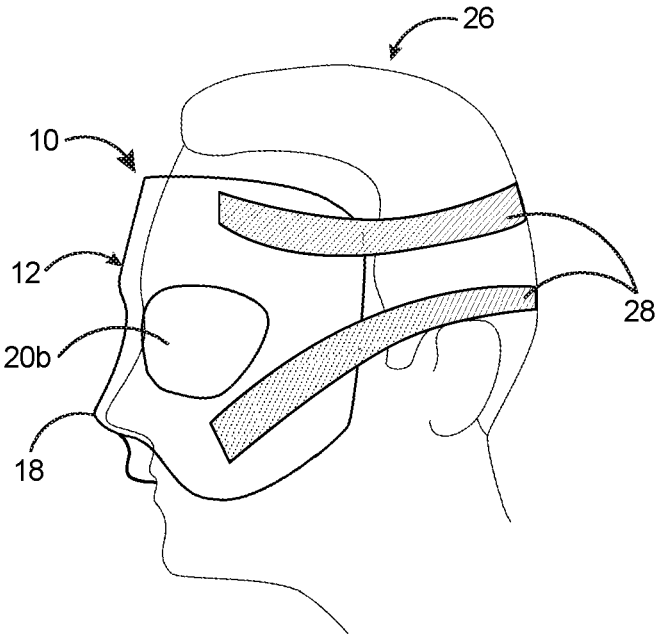

FIGS. 3A and 3B are the front and side views of the face shield 10 attached to the face of the user 26. For removing the pair of forehead pads 16 and the pair of cheek pads 14 from the face of the user 26, the user 26 has to peel off from the right or left edge to ensure the longevity of the adhesive in the pair of forehead pads 16 and the pair of cheek pads 14. The face shield 10 wraps around the sides of the head of the user 26 and the side of face and protects the user 26 from injury to the face.

Figure 4:
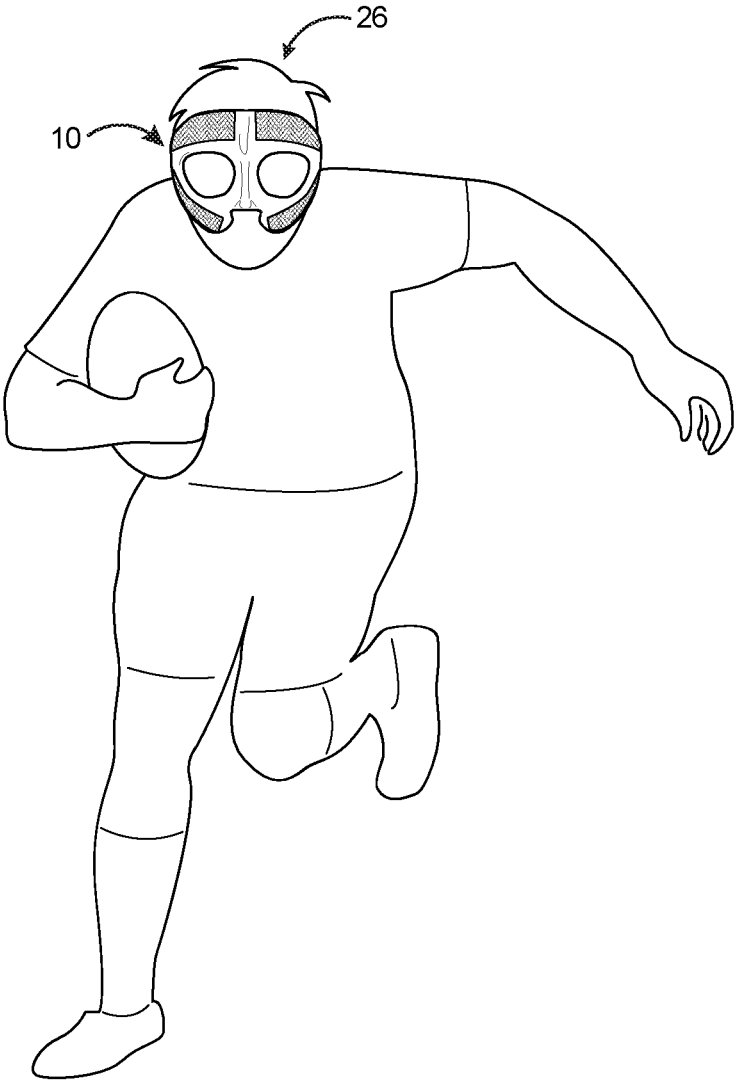
FIG. 4 is a face shield in use.

FIG. 4 illustrates a face shield 10 when in use. The face shield 10 allows the user 26 to remain active by protecting and supporting injured forehead, cheek bones and noses. The design of the face shield 10 is more unique and fits on the top of the forehead and leaves plenty of space and protects the eye portion and reduces and eliminates the vision problems. The face shield 10 is ideal for basketball, soccer, volleyball, martial arts, baseball, and other sports.

Figure 5:
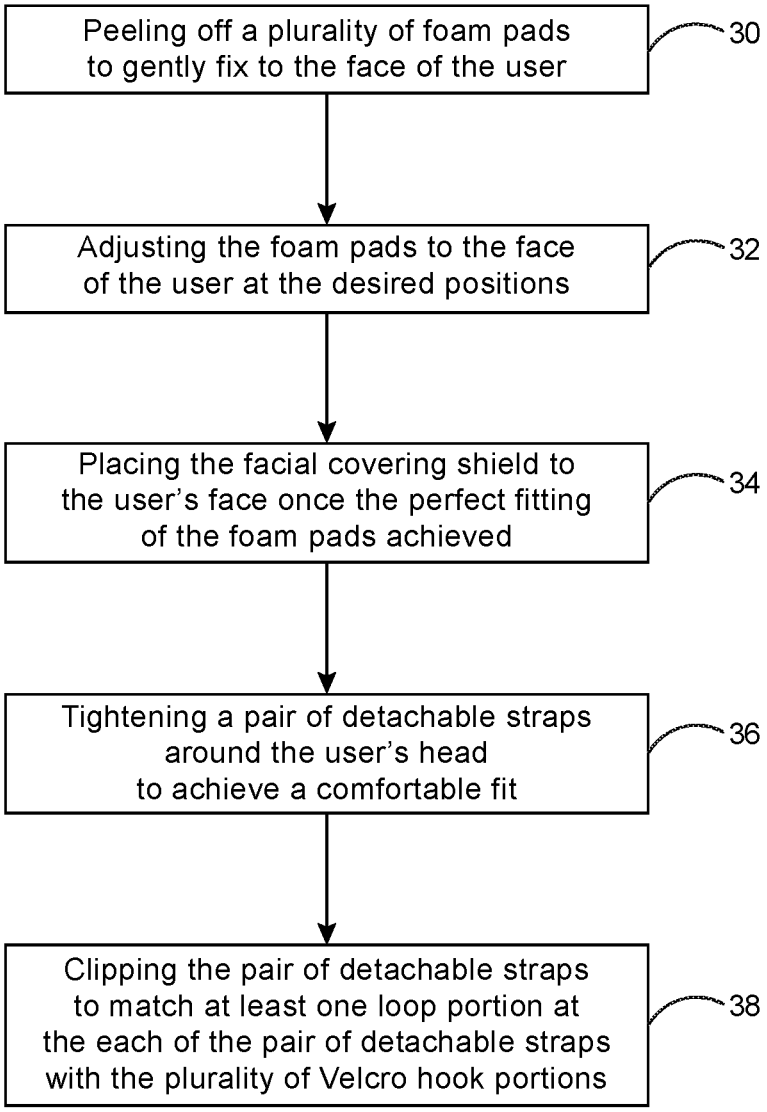
FIG. 5 is a block diagram illustrating the method for wearing the face shield on the face of the user in accordance with the preferred embodiment of the present invention.

FIG. 5 is a block diagram illustrating the method for wearing the face shield on the face of the user in accordance with the present invention. The method initiates by peeling off a plurality of foam pads to fix to the face of the user as indicated in block 30. Then, adjust the plurality of foam pads to the face of the user at the desired positions achieved as indicated in block 32. Thereafter, place the facial covering shield to the face of the user as shown in block 34. Next, once the perfect fitting of the foam pads is achieved, tighten the pair of detachable straps around the head of the user to achieve a comfortable fit as illustrated in block 36. Finally, clip the pair of detachable straps to match at least one loop portion at the each of the pair of detachable straps with the plurality of Velcro hook portions as indicated in block 38 and thus the face shield becomes ready for athletic use.

The claimed subject matter has been provided here with reference to one or more features or embodiments. Those skilled in the art will recognize and appreciate that, despite the detailed nature of the exemplary embodiments provided here; changes and modifications may be applied to said embodiments without limiting or departing from the generally intended scope. These and various other adaptations and combinations of the embodiments provided here are within the scope of the disclosed subject matter as defined by the claims and their full set of equivalents.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

The invention claimed is:

1. A face shield, comprising:

a facial covering shield having a pair of eye openings;

a plurality of foam pads that include a pair of forehead pads and a pair of cheek pads;

a nose shield portion; and a pair of detachable straps having a fastening means;

whereby the plurality of foam pads includes removable and reusable adhesive that enables the foam pads to fix on to the user's face.

2. The face shield of claim 1, wherein each of the pair of detachable straps includes a fastening means having at least one loop portion to fasten the detachable straps with the facial covering shield.

3. The face shield of claim 1 wherein the fastening means has a plurality of hook portions adaptable to attach the at least one loop portion at the ends of the each of the pair of detachable straps.

4. A face shield, comprising:

a facial covering shield having a pair of eye openings, the pair of eye openings includes a left eye opening at a left edge of the facial covering shield and a right eye opening at a right edge of the facial covering shield;

a plurality of foam pads that include a pair of forehead pads and a pair of cheek pads;

a nose shield portion enabled to cover and protect a user's nose;

a pair of detachable straps, each of the pair of detachable straps include a fastening means having at least one loop portion to fasten the detachable straps with the facial covering shield; and the fastening means having a plurality of hook portions to attach the at least one loop portion at the ends of each of the pair of detachable straps;

whereby the plurality of foam pads includes removable and reusable adhesive that enables the foam pads to fix on to the user's face.

5. The face shield of claim 4 wherein the detachable straps around the cheek and forehead are fully adjustable and provide a secure and comfortable fit for the user.

6. The face shield of claim 4 wherein the face shield is ideal for protecting injured forehead, cheek and nose regions of a sport personal engaging in outdoor games.

7. The face shield of claim 4 wherein the foam pads have removable and reusable adhesives capable of being removed from the facial covering shield.

8. A method of fixing a face shield to the face of a user, the method comprising the steps of:

a) peeling off a plurality of foam pads to gently fix to the face of the user;

b) gently adjusting the foam pads to the face of the user at the desired positions to enable perfect fitting;

c) gently placing the facial covering shield to the user's face once the perfect fitting of the foam pads achieved;

d) tightening a pair of detachable straps around the user's head to achieve a comfortable fit; and e) securing the pair of detachable straps to match at least one loop portion at each of the pair of detachable straps with the plurality of hook portions;

whereby the plurality of foam pads includes removable and reusable adhesive that enables the foam pads to fix on to the user's face.

9. The method of claim 8 wherein the pair of detachable straps around the cheek and forehead is fully adjustable and provides a secure and comfortable fit for the user.

10. The method of claim 8 wherein the face shield is ideal for basketball, soccer, volleyball, wrestling, martial arts, baseball and other sports activities.

* * * * *